US005901788A

United States Patent [19]

Brown et al.

[11] Patent Number: 5,901,788

[45] Date of Patent: May 11, 1999

[54] WELL FLUID SAMPLING TOOL AND WELL FLUID SAMPLING METHOD

[75] Inventors: Jonathan Webster Brown; Keith James Massie, both of Aberdeen, United Kingdom

[73] Assignee: Oilphase Sampling Services Limited, Aberdeen, United Kingdom

[21] Appl. No.: 08/817,377

[22] PCT Filed: Oct. 16, 1995

[86] PCT No.: PCT/GB95/02435

§ 371 Date: Jun. 16, 1997

§ 102(e) Date: Jun. 16, 1997

[87] PCT Pub. No.: WO96/12088

PCT Pub. Date: Apr. 25, 1996

[51] Int. Cl.[6] ..... E21B 49/08

[52] U.S. Cl. ..... 166/264; 73/152.23; 166/60; 166/64; 166/66; 166/66.6; 166/373

[58] Field of Search ..... 166/57, 60, 64, 166/65.1, 66, 66.6, 100, 264, 302, 332.1, 373; 73/152.23, 152.24; 175/59

[56] References Cited

U.S. PATENT DOCUMENTS

| | | | |
|---|---|---|---|
| 4,434,653 | 3/1984 | Montgomery | 73/152.24 |
| 4,583,595 | 4/1986 | Czernichow et al. | 166/264 |
| 4,766,955 | 8/1988 | Petermann | 166/167 |
| 5,337,822 | 8/1994 | Massie et al. | 166/264 |
| 5,377,755 | 1/1995 | Michaels et al. | 166/264 |
| 5,549,162 | 8/1996 | Moody et al. | 166/264 |
| 5,609,205 | 3/1997 | Massie et al. | 166/264 X |

FOREIGN PATENT DOCUMENTS

| | | |
|---|---|---|
| 0148696 | 7/1985 | European Pat. Off. . |
| 91/1241 | 8/1991 | WIPO . |

*Primary Examiner*—George Suchfield
*Attorney, Agent, or Firm*—Ratner & Prestia

[57] ABSTRACT

A well fluid sampling tool and method for retrieving reservoir fluid samples from deep wells. The sampling tool is lowered to the required depth, an internal sample chamber is opened to admit well fluid at a controlled rate, and the sample chamber is then automatically sealed. The temperature of the sampled well fluid is maintained at or near initial as-sampled temperature to avoid the volumetric shrinkage otherwise induced by temperature reduction, mitigate precipitation of compounds from the sample, and/or maintain the initial single-phase condition of the sample. The sample chamber is thermally insulated, provided with a storage heater, electrically heated, given a high hear capacity, and/or pre-heated to sample temperature.

24 Claims, 8 Drawing Sheets

WELL FLUID SAMPLING TOOL AND WELL FLUID SAMPLING METHOD

This invention related to a well fluid sampling tool and to a well fluid sampling method.

BACKGROUND OF THE INVENTION

Reservoir fluids (liquids (such as water or oil) and gas) are found in geological reservoirs wherein they are contained at a high pressure (relative to ambient atmospheric pressure), and usually also at an elevated temperature (relative to ambient atmospheric temperature). At such pressures, the gas is dissolved in the liquid such that the reservoir fluid initially exists as a single-phase fluid, but the reservoir fluid will release dissolved gas to form a two-phase fluid with separate gas and liquid components if the reservoir fluid has its initial pressure sufficiently reduced towards ambient atmospheric pressure. Also, the initial relatively high temperature of the reservoir fluid results in volumetric contraction of a given mass of fluid as it cools towards ambient atmospheric temperature if withdrawn from the well.

When hydrocarbon exploration wells, for example, are drilled and hydrocarbon fluids are found, a well fluid test is usually performed. This test usually involves flowing the well fluid to surface, mutually separating the oil and gas in a separator, separately measuring the oil and gas flow rates, and then flaring the products (or transporting the products elsewhere for use or safe disposal).

It is also desirable to take samples of the reservoir fluid for chemical and physical analysis. Such samples of reservoir fluid are collected as early as possible in the life of a reservoir, and are analysed in specialist laboratories. The information which this provides is particularly-vital in the planning and development of hydrocarbon fields and for assessing their viability and monitoring their performance.

There are two ways of collecting these samples:

1. Bottom Hole Sampling of the fluid directly from the reservoir, and
2. Surface Recombination Sampling of the fluid at the surface.

In Bottom Hole Sampling (BHS) a special sampling tool is run into the well to trap a sample of the reservoir fluid present in the well bore. Provided the well pressure at the sampling depth is above the "Bubble Point Pressure" of the reservoir fluid, all the gas will be dissolved in the liquid, and the sample will be a single-phase fluid representative of the reservoir fluid, i.e. an aliquot.

Surface Recombination Sampling (SRS) involves collecting separate oil and gas samples from the surface production facility (e.g. from the gas/liquid separator). These samples are recombined in the correct proportions at the analytical laboratory to create a composite fluid which is intended to be representative of the reservoir fluid, die a re-formed aliquot.

Several BHS tools are currently available commercially, which function by a common principle of operation. A typical BHS tool is run into the well to trap a sample of reservoir fluid at the required depth by controlled opening of an internal chamber to admit reservoir fluid, followed by sealing of the sample-holding chamber after admission of a predetermined volume of fluid. The tool is then retrieved from the well and the sample is transferred from the tool to a sample bottle for shipment to the analytical laboratory. As the tool in retrieved from the well, its temperature drops and the fluid sample shrinks causing the sample pressure to drop. This pressure drop occurs because the sample-holding chamber within the typical BES tool has a fixed volume after the sample is trapped and because the sample temperature is uncontrolled. Usually the sample pressure falls below the Bubble Point Pressure, allowing gas to break out of solution. This means the sample is now in two phases, a liquid phase and a gas phase, instead of in single-phase form as it was before the pressure dropped. In order successfully to transfer the sample from the tool to the sample bottle, it is necessary to pre-pressurise the sample sufficiently to force the free gas back into solution, recreating a single-phase sample. This recombination is a lengthy procedure and thus expensive.

The temperature change which the sample experiences and the resultant pressure change may also cause the precipitation of compounds previously dissolved in the well fluid, some of which cannot be re-dissolved by re-pressurisation. The absence of these compounds in the re-formed aliquot renders certain analyses meaningless.

A means by which a well fluid sample could be collected, retrieved and transferred in single-phase form, without a pressure-induced phase change, would a mitigate these problems. Not only would time spent recombining a two-phase sample back to single phase be saved, but pressure-sensitive compounds would remain dissolved, allowing more accurate analyses to be performed on the sample. One such means is described in our co-pending European Patent Application EP-A-0515495, which utilises pressurisation of the sample to maintain the sample in single-phase form.

In more general terms, it is also desirable to retrieve a sample whose temperature is close to its original temperature.

BRIEF SUMMARY OF THE INVENTION

According to a first aspect of the present invention there is provided a well fluid sampling tool comprising a sample chamber; operative means for the tool operative to admit a well fluid sample to said sample chamber; and temperature maintenance means for maintaining the temperature of a well-fluid sample held within said sample chamber, the temperature maintenance means acting to counteract changes in temperature of the sample.

Preferably, the temperature maintainteance means acts to maintain said well fluid sample in single-phase form.

Preferably, the temperature maintenance means is formed as a storage heater.

Said temperature maintenance means may comprise heat retention means which preferably comprises thermal insulation means disposed to minimise heat loss from a well-fluid sample at an elevated temperature relative to ambient temperature and held within the sample chamber. Said thermal insulation means preferably comprises a heat insulating jacket at least partially surrounding the sample chamber, the jacket being formed of a material or materials having a low thermal conductivity and preferably also exhibiting low thermal radiation characteristics. The jacket preferably also has a high specific heat capacity. Said thermal insulation means may additionally or alternatively comprise an evacuated jacket at least partially surrounding the sample chamber. The evacuated jacket may comprise at least part of the heat insulating jacket.

Said temperature maintenance means may additionally or alternatively comprise heat generation means for generating heat in or adjacent the sample chamber. The heat generation means preferably comprises electrically energised electric heater means conveniently in the form of a dissipative resistor disposed on and/or in the sample chamber. The resistor may be in the form of an elongate tape wound around the sample chamber. Alternatively, the resistor may be in the form of a resistive coating. Electrical energy for energisation of the electric heater means may come from batteries or any other suitable source of electrical energy comprised within the sampling tool; additionally or alternatively, the electrical energy may come from an out-of-tool source, e.g. a wellhead generator, and be conveyed to the sampling tool by means of an electric cable.

According to the second aspect of the present invention there is provided a well fluid sampling method comprising the steps of providing a well fluid sampling tool comprising a sample chamber, lowering said tool down a well to a location where well fluid is to be sampled, admitting a sample of well fluid into said sample chamber and then sealing said sample chamber, and maintaining the temperature of the well fluid sample held within the sample chamber while raising the tool and the sample up the well, in a manner tending to counteract changes in temperature of the well fluid sample.

Preferably, the sampled well fluid is maintained in single-phase form.

In said method of well fluid sampling, said well fluid sampling tool is preferably a well fluid sampling tool according to the first aspect of the present invention.

The method may comprise the step of holding the tool adjacent the sampling location, or in another region of elevated temperature, for a period at least sufficient to elevate the temperature of the sample chamber towards the anticipated temperature of the sample to be taken. The method may comprise the alternative or additional step of pre-heating the sample chamber prior to lowering the sampling tool down the well.

BRIEF DESCRIPTION OF THE SEVERAL VIEWS OF THE DRAWINGS

Embodiments of the invention will now be described, by way of example, with reference to the accompanying drawings wherein.

DETAILED DESCRIPTION OF THE INVENTION

Before describing the embodiments in detail, it will be mentioned that the illustrated embodiment has much in common with the well-fluid sampling tool described in our co-pending European Patent Application EP-A-0515495, though the present invention is fundamentally different in at least one important respect. The following description will concentrate on the novel aspects of the embodiments, and for complete details of other aspects, reference should be made to the published specification of the aforementioned EP-A-0515495.

Figure 1:
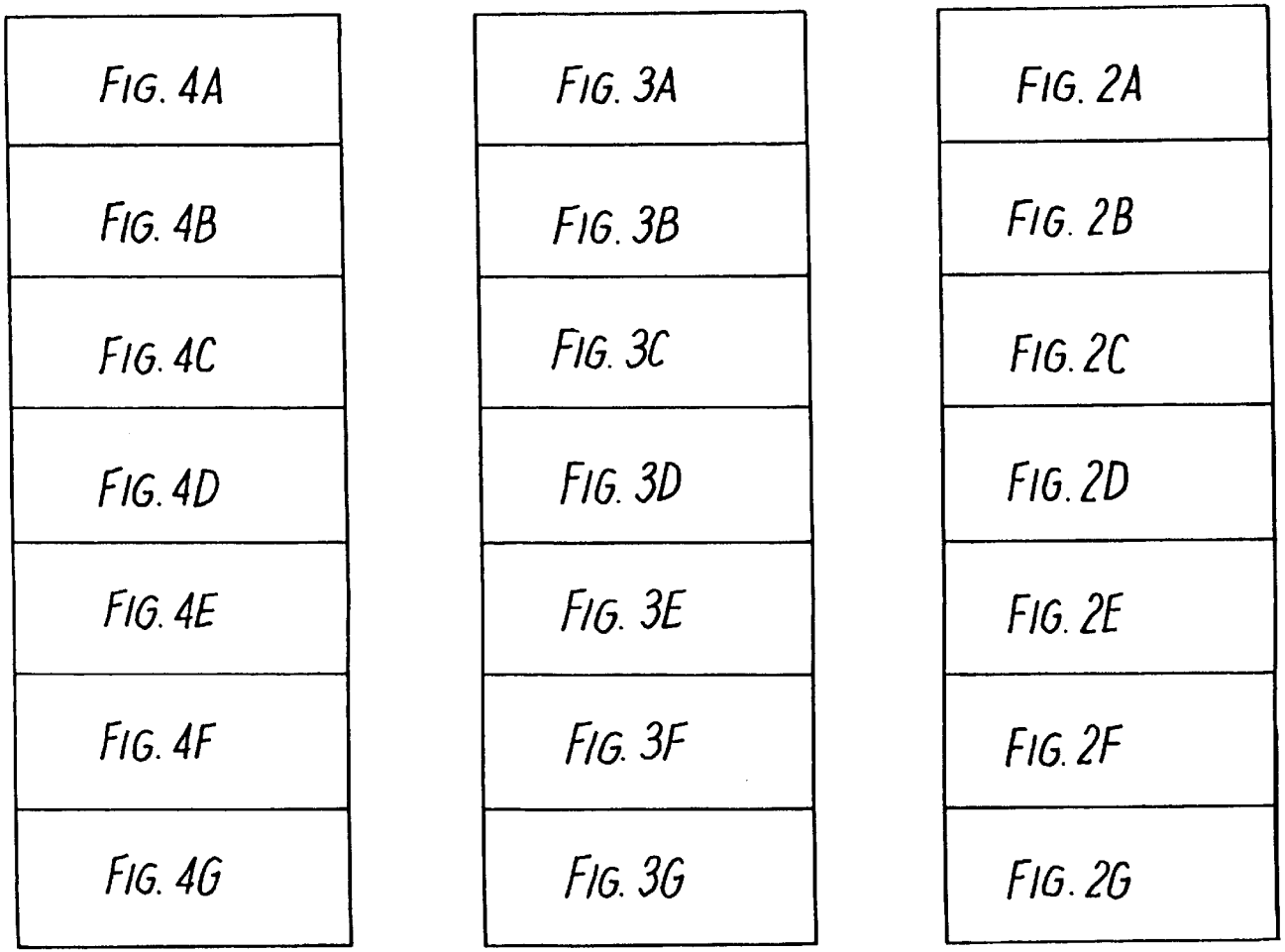
FIG. 1 diagrammatically illustrated the order of assembly of FIGS. 2A–4G to form composite figures.
Figure 2A:
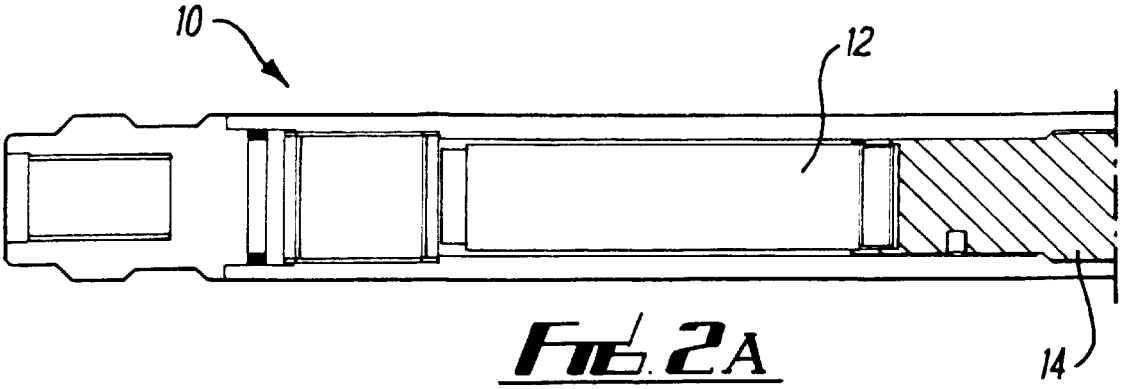
FIGS. 2A–2G (assembled as indicated in FIG. 1 to form a composite FIG. 2) illustrate a longitudinal section of a well fluid sampling tool in accordance with the invention, the tool being in a pre-sampling configuration.
Figure 2B:
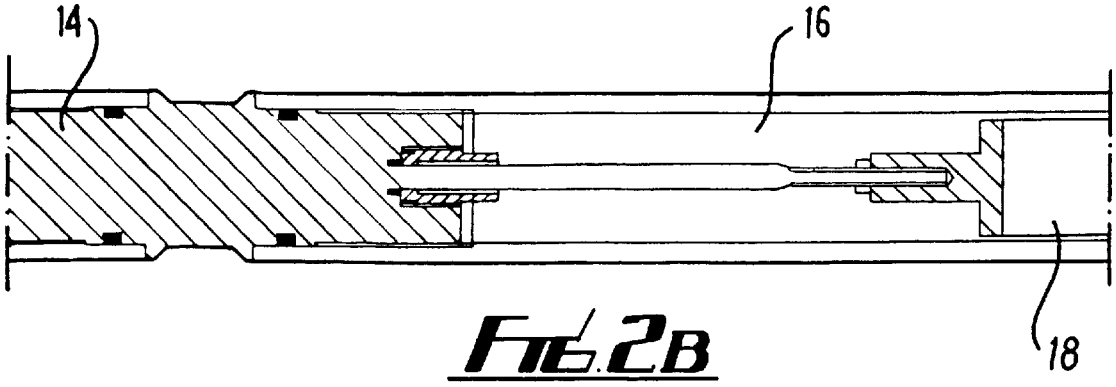
Figure 2C:
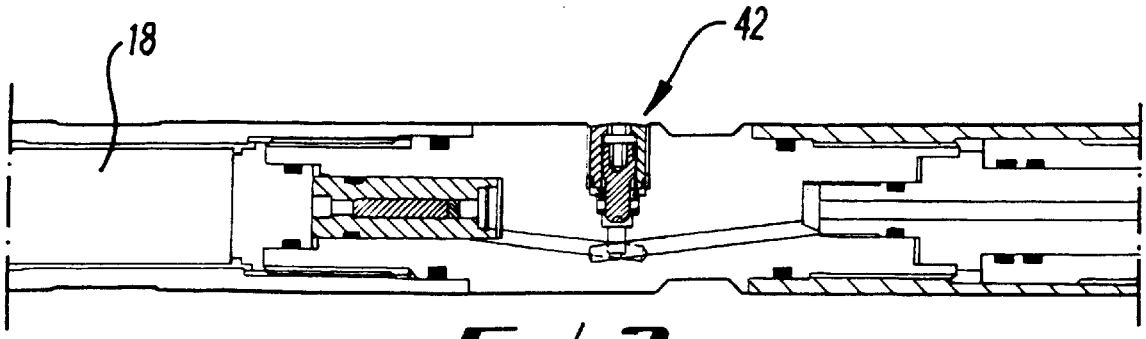
Figure 2D:
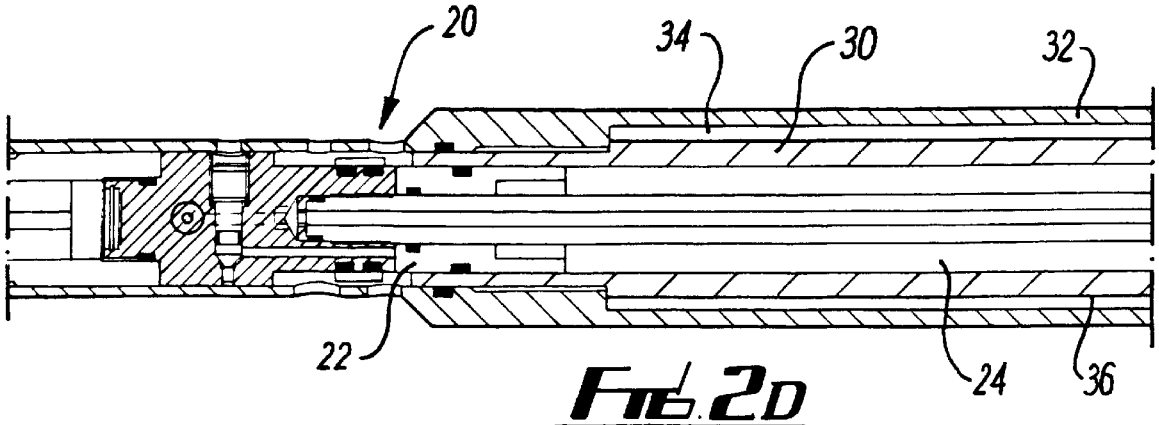
Figure 2E:
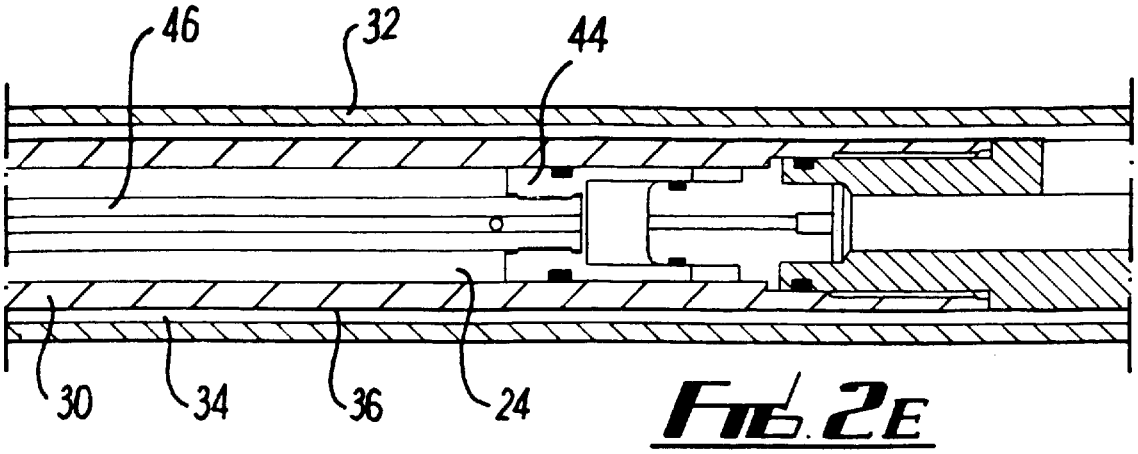
Figure 2F:
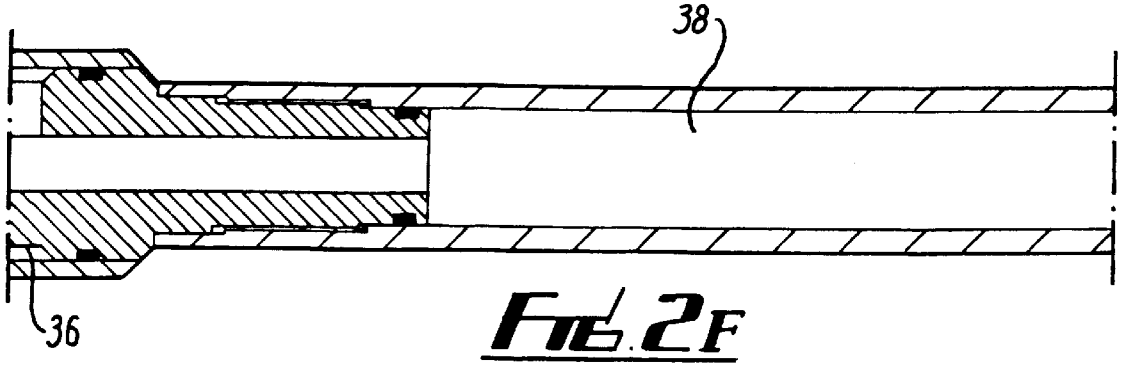
Figure 2G:
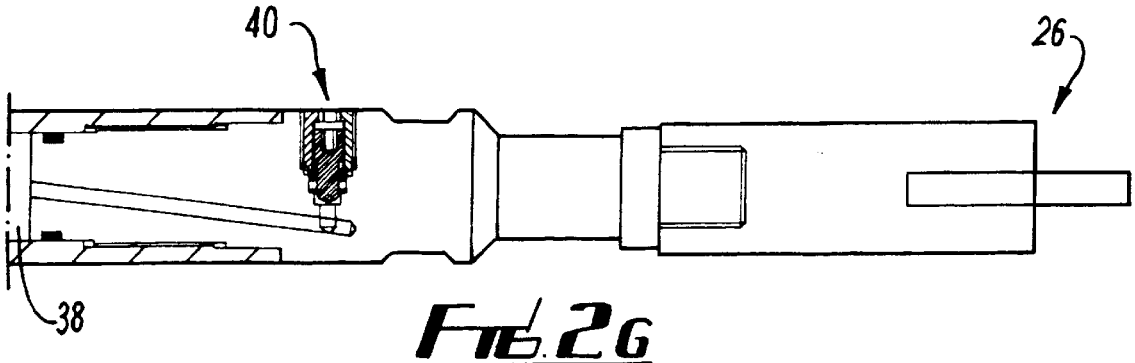

Referring first to composite FIG. 2, a well-fluid sampling tool 10 comprises an elongate linear assembly (within a multi-component casing) of a clock 12, a clock-actuated trigger assembly 14, an air chamber 16, a trigger-actuated valve 18, a sample inlet valve 20, a sampling piston 22, a sample chamber 24, and a wireline connector 26 at the top of the tool 10. Details of the afore-mentioned components and sub-assemblies of the tool 10 are given in the published specification of EP-A-0515495, except for details of the novel sample chamber 24, which are given below.

The sample chamber 24 comprises an inner tube 30 of a material having properties suitable for use as a sample chamber, i.e. mechanical strength and durability, and resistance to chemical attack by well fluids. The material of the inner tube 30 is also selected to have a high specific heat capacity.

The sample chamber 24 further-comprises an outer tube 32 of a thermally insulating material also having a high specific heat capacity, as well as adequate mechanical properties and corrosion resistance. The material of the outer tube 32 may be a suitable ceramic or be formed of steel having a thermally insulating coating.

The annulus 34 between the inner and outer tubes 30, 32 may be evacuated such that the vacuum around the sample chamber 24 further improves thermal insulation of the sample chamber 24. The annulus 34 may be filled with an aerogel as an additional insulating material.

Figure 3A:
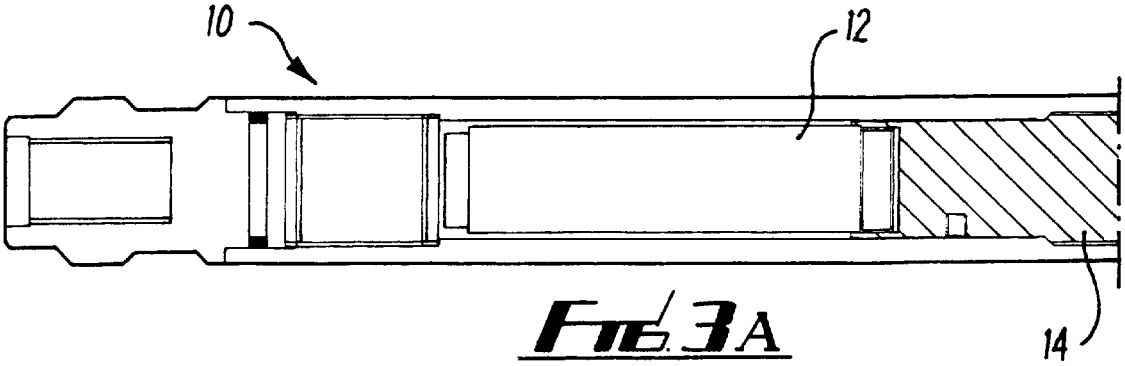
FIGS. 3A–3G (assembled as indicated in FIG. 1 to form a composite FIG. 3) illustrate the tool of FIG. 2 in its sampling configuration, i.e. in the process of sampling a surrounding well fluid.
Figure 4A:
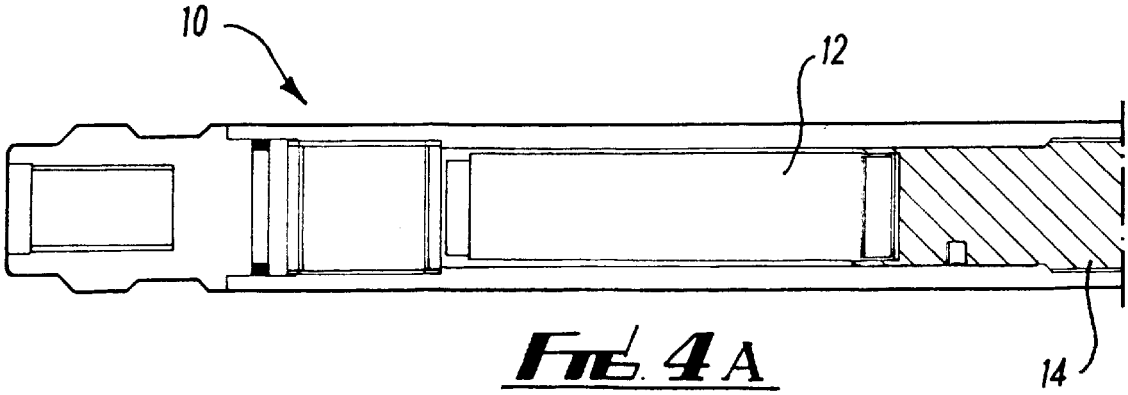
FIGS. 4A–4G (assembled as indicated in FIG. 1 to form a composite FIG. 4) illustrate the tool of FIG. 2 in its post-sampling configuration.
Figure 3B:
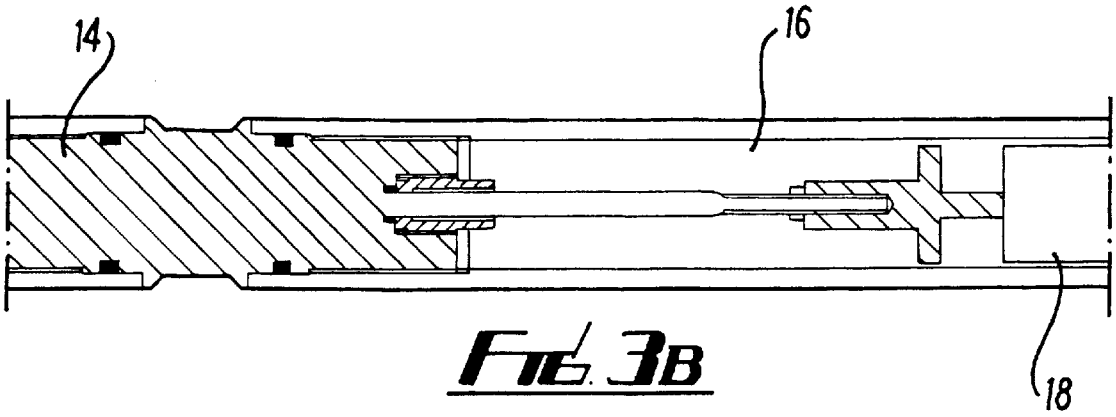
Figure 4B:
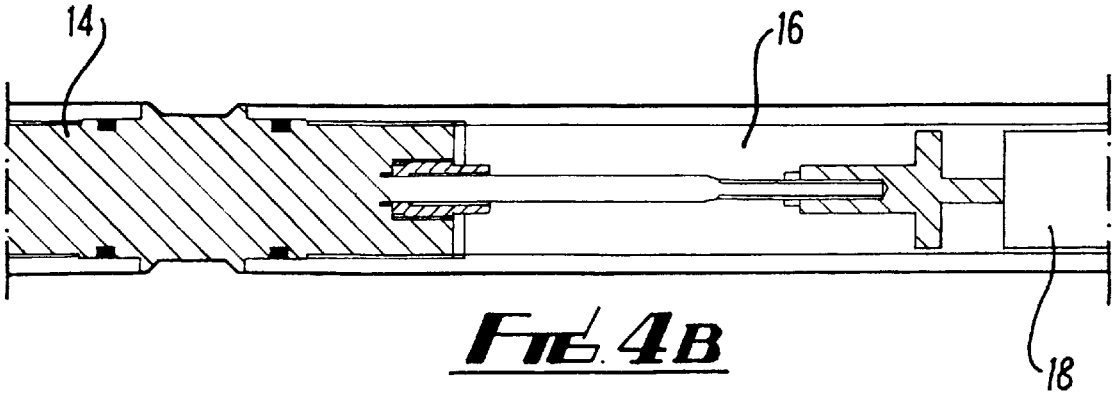
Figure 3C:
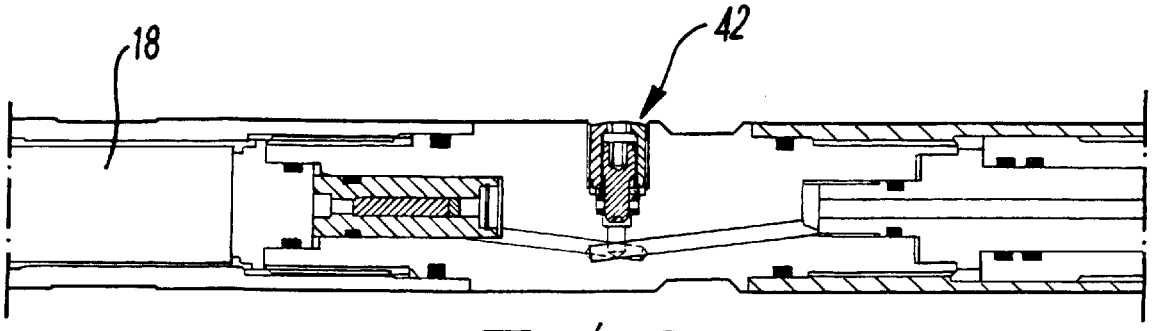
Figure 4C:
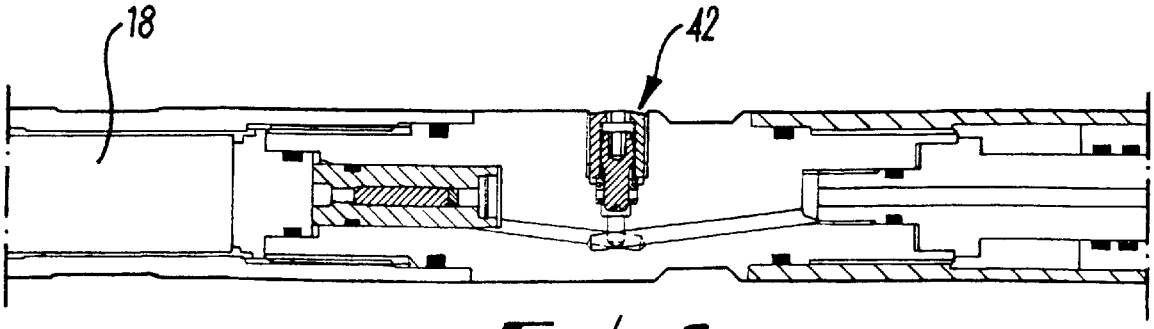
Figure 3D:
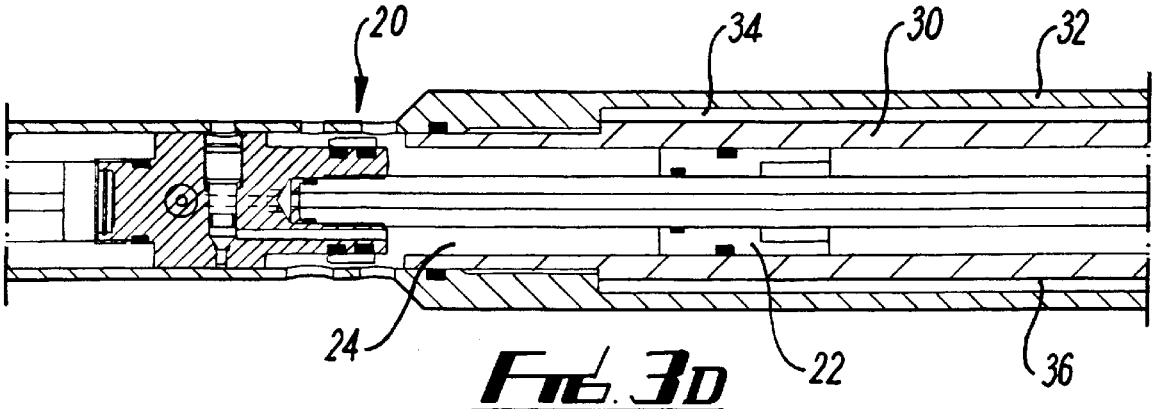
Figure 4D:
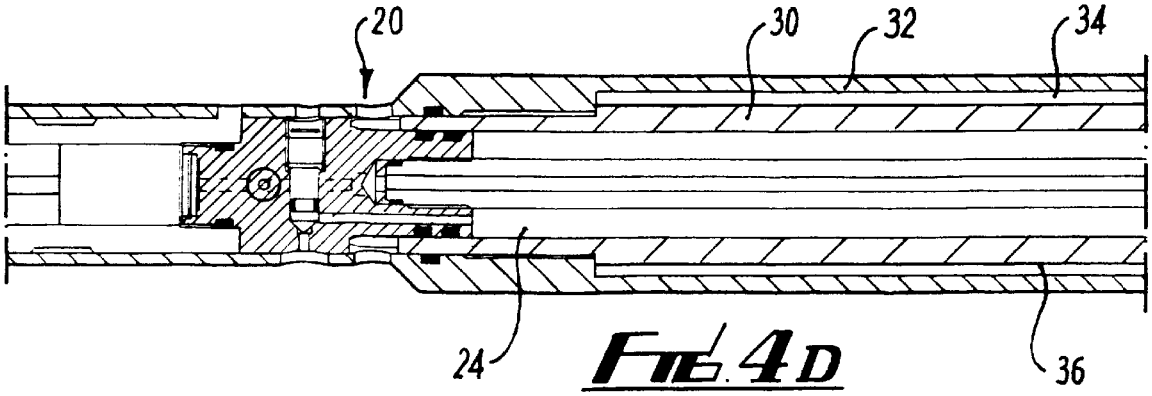
Figure 3E:
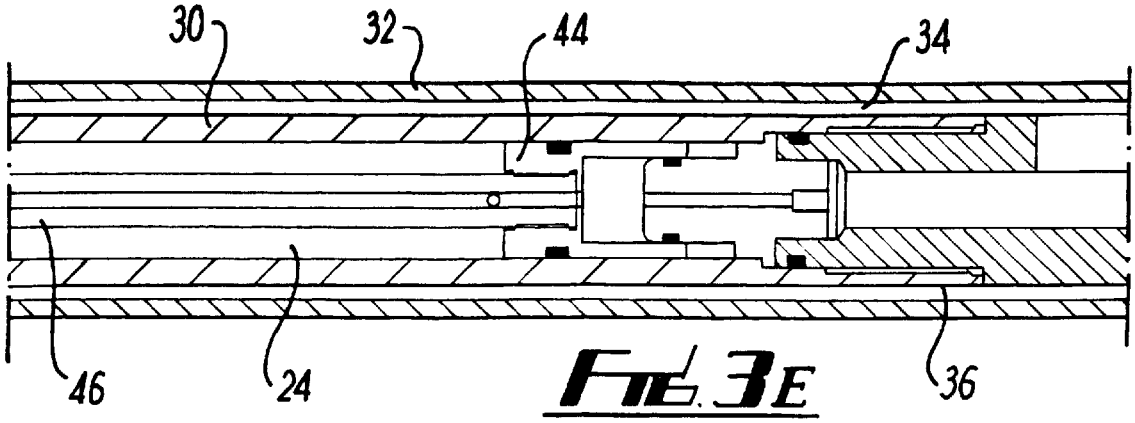
Figure 4E:
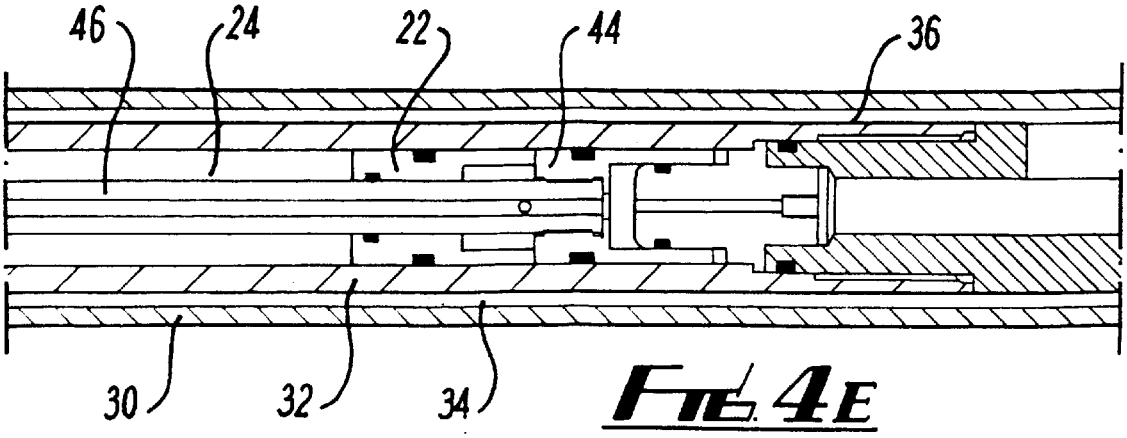
Figure 3F:
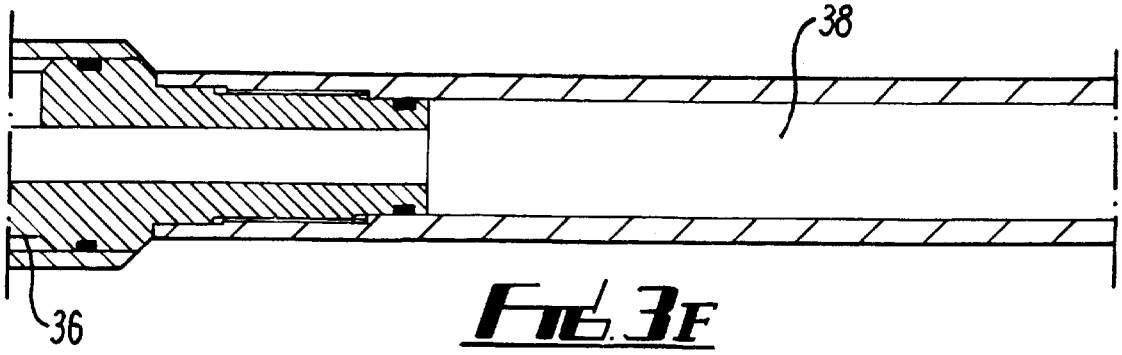
Figure 4F:
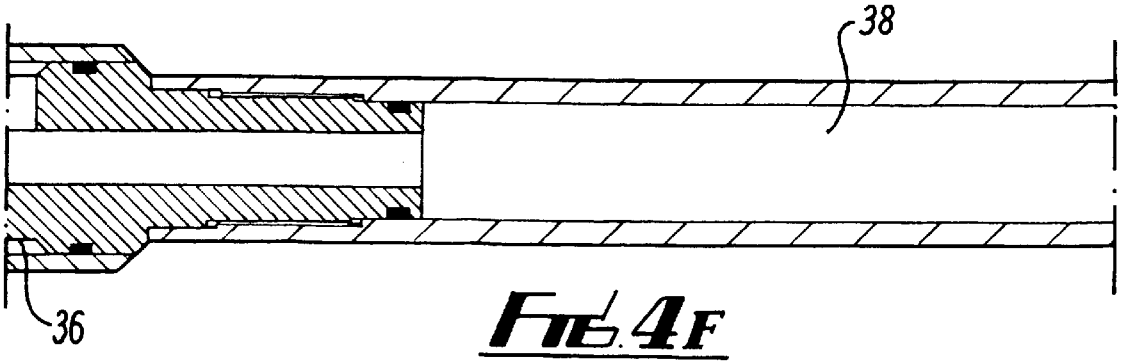
Figure 3G:
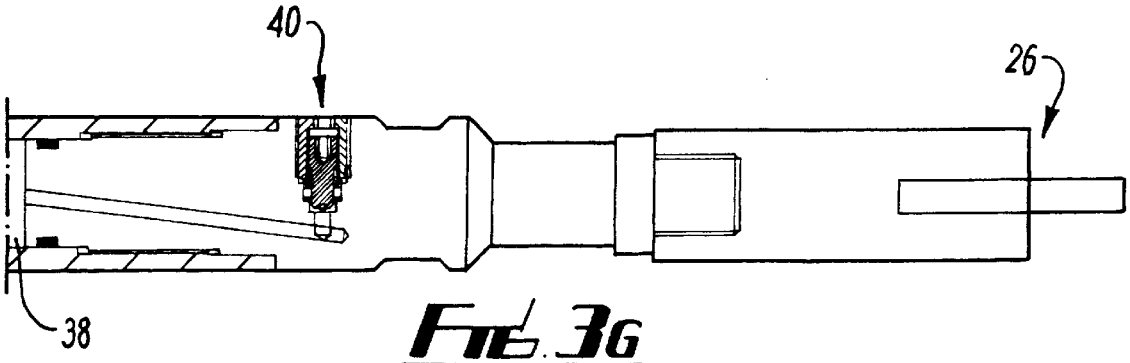
Figure 4G:
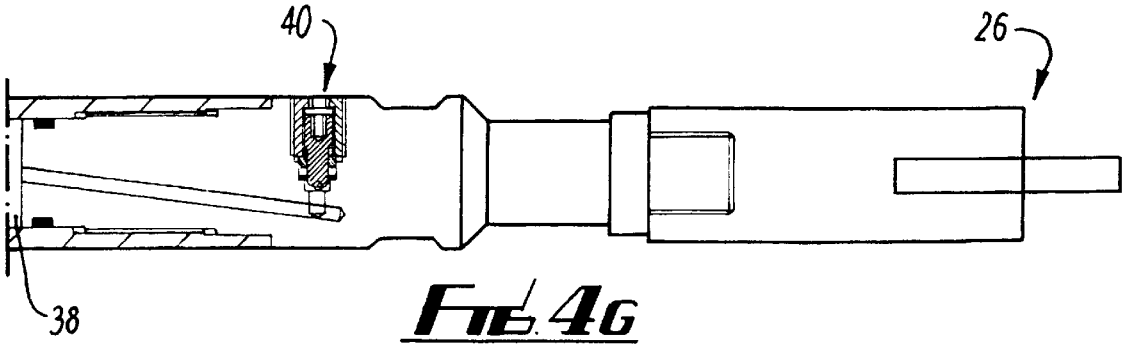

The exterior of the inner tube 30 is wound with an electrical resistance heater 36 in the form of a tape or foil or may be coated with a resistive coating. The heater 36 is connected (by means not shown) to a control circuit and battery pack (not shown) mounted inside a battery chamber 38 forming part of the sampling tool 10 between the upper end of the sampling chamber 24 (the right-hand end of the sample chamber 24 as viewed in FIGS. 2, 3 & 4) and the wireline connector 26.

Electric power for the heater 36 may additionally or alternatively be supplied from an external generator or electric mains (not shown), conveniently though an electric cable (not shown) paralleling (or serving in place of) the wireline (not shown) coupled to the wireline connector 26 (which is suitably adapted to the transfer of electric power as well as mechanical lifting forces).

Operation of the well-fluid sampling tool 10 will now be described.

On the surface above the well whose fluid is to be sampled, the tool 10 is prepared for sampling operation by setting the internal components to the positions shown in FIG. 2 (in particular, setting the sampling piston 22 to the lower (left) end of the sample chamber 24), evacuating the annulus 34 through a re-closable valve 40, setting (but not yet initiating operation of) the clock 12 to respond after a predetermined time delay, and pressurising the upper (right) end of the sample chamber 24 above the piston 22 with hydraulic oil. The hydraulic oil is injected through a priming valve 42 until the upper end of the sample chamber 24 is filled with oil at a pressure greater than the fluid pressure at the location where the sample is eventually to be taken.

The pre-pressurisation holds the piston 22 against the bottom of the sample chamber 24 against upward force on the piston 22 produced by the pressure of well fluids entering the initially open sample inlet valve 20, until the piston 22 is released for sample taking by opening the valve 18 within the trigger assembly 14 to depressurise the hydraulic pre-filling by draining it into the air chamber 16.

If necessary or desirable, the sample chamber 24 is pre-heated by energising the heater element 36, using either the batteries (previously charged and installed in the battery chamber 38) or an external power supply, such as a wellhead generator or mains power. The inner tube 30, together with the heater element 36 and suitable further thermal insulation, may be combined as a form of storage heater which may be detachable from the rest of the tool 10 for convenience in pre-heating and other purposes (e.g. sample handling and sample chamber cleaning).

The prepared tool 10 is connected to a wireline (not shown) by means of the connector 26 and lowered down the well to the location at which a well fluid sample is to be taken. If the tool 10, and the sample chamber 24 in particular, are not yet at or near the ambient temperature at the sampling location, the tool 10 is suspended at the sampling location until temperature equilibrium is approached or reached. (While beneficial in ways which are detailed below, the thermal insulation of the sample chamber 24, and the high specific heat capacity of the sample chamber materials make the sample chamber slow to warm up to downhole ambient temperature; pre-heating reduces this delay).

At the preselected time, the clock 12 reaches the end of the pre-set delay period and actuates the trigger assembly 14 to open the valve 18 as shown in composite FIG. 4, allowing hydraulic oil to drain from the upper (right) end of the sample chamber 24 into the air chamber 16. This allows the sampling piston 22 to move up (rightwards along) the sample chamber 24 under the pressure of well fluid entering the lower (left) end of the sample chamber 24 through the sample inlet valve 20. The rate at which hydraulic oil flows into the air chamber 16 is metered to control the rate at which well fluid enters the sample chamber 24 to level low enough to avoid a pressure drop across the valve 20 that would otherwise cause dissolved materials to come out of solution in the liquid component of the well fluid.

As the sample chamber 24 becomes filled, the piston 22 abuts a closing sleeve 44 defining the upper (rightward) end of the sample chamber, and through a hollow pull-rod 46 (part of the path by which hydraulic oil was drained from the chamber 24 to the chamber 16), further upwards (rightward) movement of the piston 22 pulls the sample inlet valve 20 to its closed position as illustrated in composite FIG. 4. Apart from the pre-heating step, the above described part of the sampling procedure is more fully detailed in our co-pending European Patent Application EP-A-0515495.

Once the sample inlet valve 20 is closed, the downhole part of the sampling procedure is complete, and the sampling tool is pulled back up the well to the surface, with the hot, high-pressure well fluid sample sealed inside the sample chamber 24. The initial temperature of the well-fluid sample, i.e. the temperature of the well fluid at the time of sampling, is substantially maintained by the storage heater arrangement and by the structure of the sample chamber 24, i.e. by the thermal isolation provided by the use of thermally insulating material for the outer tube 32, together with the evacuation of the annulus 34 between the outer and inner tubes 32 & 30, and also by the high specific heat capacities of the materials selected to form the tubes 30 and 32.

If the sample temperature should commence to fall significantly, such a temperature fall would be detected by the control circuit (in the chamber 38) through a sample temperature sensing means (not illustrated), for example a thermistor or thermocouple in thermal contact with the sample. In response to the detected temperature drop, the control circuit would connect the batteries (also in the chamber 38) to the heater 36 so as to heat up the underlying inner tube 30 and thereby maintain the sample against untoward cooling.

The highly desirable effect of maintaining the temperature of the sampled well fluid at or near initial as-sampled temperature is the preservation of the initial volume of the sampled well fluid without the volumetric shrinkage otherwise induced by is temperature reduction, and consequently the maintenance of the well-fluid sample at or sufficiently near its initial pressure as to obviate loss of the initial single-phase condition of the sample otherwise induced by shrinkage.

In our co-pending European Patent Application EP-A-0515495, the initial single-phase condition of the well fluid sample was maintained by externally pressurising the sample chamber from an in-tool pressure source as soon as the sample was taken; in the present invention the initial single-phase condition of the well-fluid sample is maintained by maintaining the temperature of the sample sufficiently to prevent cooling of the sample to the point at which there would be significant loss of single-phase condition, and without resort to internal pressurisation of the sample chamber.

Modifications and variations of the above-described preferred embodiment can be adopted without departing from the scope of the invention as defined in the appended Claims.

We claim:

1. A well fluid sampling tool comprising a sample chamber; operating means for the tool operative to admit a well fluid sample to said sample chamber; and temperature maintenance means for maintaining the temperature of a well fluid sample held within the sample chamber, the temperature maintenance means acting to counteract changes in temperature of the sample.

2. A sampling tool as claimed in claim 1 wherein said temperature maintenance means acts to mitigate precipitation of compounds from the well fluid sample.

3. A sampling tool as claimed in claim 1 wherein said temperature maintenance means maintains said well fluid sample in single-phase form.

4. A sampling tool as claimed in claim 1 wherein said temperature maintenance means is formed as a storage heater.

5. A sampling tool as claimed in claim 1 wherein said temperature maintenance means comprises heat retention means.

6. A sampling tool as claimed in claim 5 wherein said heat retention means comprises thermal insulation means disposed to minimise heat loss from a well fluid sample at an elevated temperature relative to ambient temperature and held within the sample chamber.

7. A sampling tool as claimed in claim 6 wherein said thermal insulation means comprises a heat insulating jacket at least partially surrounding the sample chamber.

8. A sampling tool as claimed in claim 7 wherein said jacket is formed of a material or materials having a low thermal conductivity.

9. A sampling tool as claimed in claim 7 wherein said jacket is formed of a material or materials having a high specific heat capacity.

10. A sampling tool as claimed in claim 7 wherein said jacket is formed of a material or materials having low thermal radiation characteristics.

11. A sampling tool as claimed in claim 6 wherein said thermal insulation means comprises an evacuated jacket at least partially surrounding the sample chamber.

12. A sampling tool as claimed in claim 1, wherein said temperature maintenance means comprises heat generation means for generating heat in or adjacent the sample chamber.

13. A sampling tool as claimed in claim 12 wherein said heat generation means comprises electrically energised electric heater means.

14. A sampling tool as claimed in claim 13 wherein said electric heater means is a dissipative resistor disposed on and/or in the sample chamber.

15. A sampling tool as claimed in claim 14 wherein said resistor is in the form of an elongate tape wound around the sample chamber.

16. A sampling tool as claimed in claim 14 wherein said resistor is in the form of a resistive coating formed on the sample chamber.

17. A sampling tool as claimed in claim 13 and further comprising a source of electrical energy within the sampling tool.

18. A sampling tool as claimed in claim 13 wherein electrical energy for energization of the electric heater means is provided by an out-of-tool source and conveyed to the sampling tool by means of an electric cable.

19. A well fluid sampling method comprising the steps of providing a well fluid sampling tool comprising a sample chamber, lowering said tool down a well to a location where well fluid is to be sampled, admitting a sample of well fluid into said sample chamber and then sealing said sample chamber, and maintaining the temperature of the well fluid sample held within the sample chamber while raising the tool and the sample up the well, in a manner tending to counteract changes in temperature of the well fluid sample.

20. A method as claimed in claim 19, wherein maintaining temperature of the well fluid sample acts to mitigate precipitation of compounds from the sample.

21. A method as claimed in claim 19, wherein the sampled well fluid is maintained in single-phase form.

22. A method as claimed in claim 19, wherein said well fluid sampling tool comprising a sample chamber; operating means for the tool operative to admit a well fluid sample to said sample chamber; and temperature maintenance means for maintaining the temperature of a well fluid sample held within the sample chamber, the temperature maintenance means acting to counteract changes in temperature of the sample.

23. A method as claimed in claim 19, the method comprising the further step of holding the tool adjacent the sampling location, or in another region of elevated temperature, for a period at least sufficient to elevate the temperature of the sample chamber towards the anticipated temperature of the sample to be taken.

24. A method as claimed in claim 19, the method comprising the additional step of pre-heating the sample chamber prior to lowering the sample tool down the well.

* * * * *